United States Patent [19]

Moench, Sr.

[11] 4,070,129

[45] Jan. 24, 1978

[54] EARTH COMPACTING EQUIPMENT

[76] Inventor: Frank Fred Moench, Sr., 4209 San Pedro NE., Albuquerque, N. Mex. 87109

[21] Appl. No.: 704,498

[22] Filed: July 12, 1976

[51] Int. Cl.[2] ..... E01C 19/26

[52] U.S. Cl. ..... 404/127

[58] Field of Search ..... 404/127, 122, 128

[56] References Cited

U.S. PATENT DOCUMENTS

| | | | |
|---|---|---|---|
| 2,891,335 | 6/1959 | Linneman | 404/127 X |
| 3,072,025 | 1/1963 | Cronin | 404/127 |
| 3,302,540 | 2/1967 | Fuentes | 404/127 |
| 3,891,342 | 6/1975 | Roe | 404/127 X |

*Primary Examiner*—Nile C. Byers

*Attorney, Agent, or Firm*—Richard D. Law

[57] ABSTRACT

A compaction roller pivotally mounted on an extensible boom-type support, arranged to be lowered at a predetermined angle into an excavated ditch, having control means for changing the angle to a horizontal position and the length of the boom.

5 Claims, 5 Drawing Figures

EARTH COMPACTING EQUIPMENT

This invention relates to earth compacting equipment, specifically to earth compaction of backfilled ditching excavations. Particularly the invention relates to equipment combining backfill capability with comapaction capability so that one piece of equipment preforms the two functions.

PRIOR ART

One type of backfill compaction device is shown in U.S. Pat. No. 2,891,337, issued June 23, 1959 to F. H. Linneman for ROAD REPAIR EQUIPMENT ROLLER ATTACHMENT FOR GRADERS. This device is a motor grader having a forwardly directed, non extensible boom supporting a sheep's foot compaction roller. The boom is arranged to be lowered into a ditch wider than boom arms so that the roller compacts only the center of the backfilled dirt as the motor grader moves along the ditch. Thus, the unit partially compacts the backfilled earth and similtaneously blades in additional backfill dirt into the ditch. The rigid length boom is arranged to press into the backfilled earth in the ditch, raising the front wheels of the grader. The angle of the boom in the ditch changes according to the depth of the backfill dirt, thus changing the moment arm between the sheep's foot roller and the grader rear wheels and changing the compression on the backfill dirt.

A modification of backfill, compaction equipment is shown in U.S. Pat. No. 3,595,411, issued July 27, 1971 to Eugene O. Ables. In this device the packing or compaction roller is mounted on a backhoe bucket, which is mounted in generally a conventional fashion on an articulated boom. The compaction roller is mounted as an extension on the backhoe bucket itself, and, therefore, it must follow the motions of the bucket itself. Thus, the unit is arranged for pulling backfill dirt into the excavation, and for compacting the backfilled dirt by applying pressure on the compaction roller in the excavation with bucket pulled up. A somewhat similar type of equipment is shown in U.S. Pat. No. 3,891,342 patented June 24, 1975 to Harry James Roe. In this device the compacting roller is mounted in the bucket so that it becomes a scraper for pulling dirt into the excavation and tamping means for tamping dirt pulled into the excavation. Both of these patents are provided with sheep's foot rollers, but the positioning of rollers limits the compaction arc of the boom. This is due to bucket to which the roller is attached.

GENERAL DESCRIPTION OF THE INVENTION

The present invention provides for a compacting roller mounted on an extensible boom-type support on a motor grader, or the like. The compaction roller is mounted in a support comprised of spaced apart arms not essentially wider than the roller. Means are provided for controlling the relative elevation of the roller by changing the length of the boom, and controlling the angle of the boom so that the moment arm between the roller and the grader's rear wheels may be controlled.

Included among the objects and advantages of the present invention is a compaction roller assembly for motor graders.

Another object of the invention is to provide a compaction type roller extensible for boom-type support means where in the angle of the boom for the roller may be controlled for controlling compaction in a ditching excavation.

Another object of the invention is to provide a compaction type roller for boom-type support means which is arranged to be compact across the lateral extent of a backfilled ditching excavation.

These and other objects and advantages of the invention may be readily ascertained by reference to the following description and appended drawings, in which.

Figures 1, 2, 3, 4, 5:
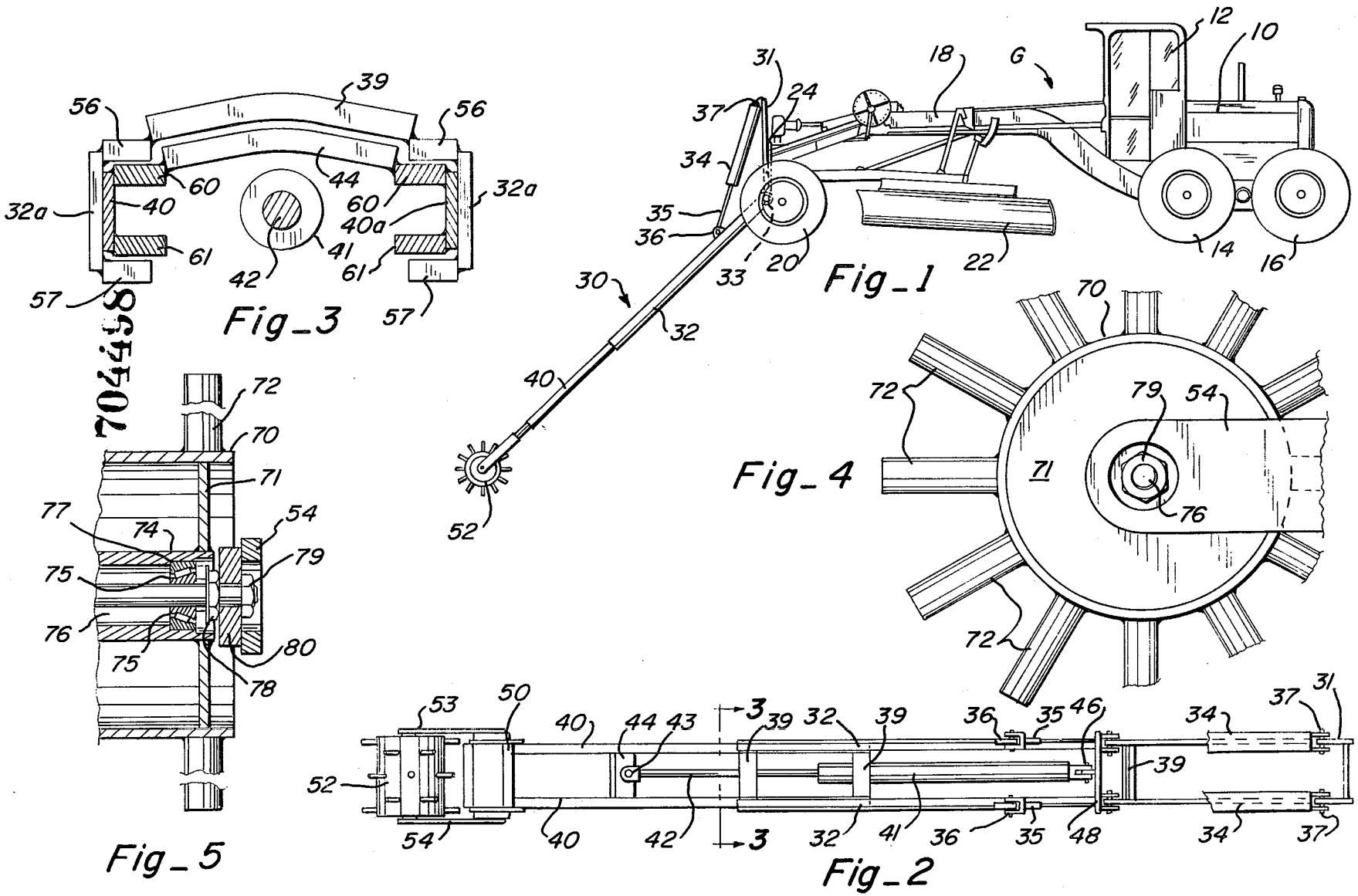
FIG. 1 is a side elevational view of the device of the invention, with an extensible boom depending from the front of a motor grader with a sheep's foot roller mounted on the end of the boom.
FIG. 2 is a top plan view of the boom of the invention, partially cut away, illustrating the operating components of the extensible boom.
FIG. 3 is a cross-sectional view of the boom of FIG. 2, taken along section lines AA.
FIG. 4 is an enlarged detail view of the sheep's foot roller according to the invention.
FIG. 5 is a detail view of one side of the rotatable mounting of the sheep's foot roller according to the invention.

In the device of FIG. 1, a more or less conventional motor grader is shown in general by the letter G, and it includes an engine 10, a cab 12, rear wheels 14 and 16, ana a bow frame member 18 which terminates with steerable front wheels 20. A movable grading blade 22 is mounted below the frame 18, all in conventional manner. At the front of the frame portion 18 is a front plate 24 which is mounted between the pair of stirable front wheels 20.

An extensible boom, shown in general by numeral 30, is mounted on a frame 31 which is attached to the front plate of the grader 24. A main boom frame assembly 32 is pivotally mounted by means of pivot 33 to the bottom of the frame 31 and is arranged to pivot upwardly and downwardly about the pivot 33. A pair of hydraulic cylinders 34 provide means for controlling the angle of the boom frame 32 in relation to the plate 24. The cylinders 34 include spaced piston rods 35 pivotally mounted by means of pivot pins 36 to the boom frame 32, in a conventional manner. In a like manner, cylinders 34 are pivotally mounted by means of pivots 37 to the top of the frame 31. The frame 32, shown in FIG. 2 is an open frame including side rails with cross-rail supports 39, and the pair of cylinders 34 are attached by means of the piston rod 32 to the pivot 36 to the two spaced apart rails. An inner, extensible frame, which includes side rails 40, reciprocates in the upper frame member as described below. The inner frame member is controlled by means of hydraulic cylinder 41, having a piston 42 pivotally attached, by means of pivot pin 43, to a lateral support plate 44 between the two side rails. The cylinder 41 is attached by means of pivot pin 46 to an end plate 48 at the end of the side rails 32 of the upper frame. The outer end of the side rails of the inner boom member is enclosed by a box-configuration assembly 50 to which is attached a sheep's foot roller 52 by means of side connectors 53 and 54.

The side rails of the upper boom member are built-up channels which include outer plates **32*a* and normal plates 56 and 57 welded to the plate 32 to form a channel in which the inner boom member is reciprocally mounted. The cross plates 39 are welded to the upper plates 56 of the channel members. In a similar manner, the inner boom includes side channels formed of side members 40***a* with normal leg members 60 and 61 welded thereto, these are tied together by the cross member 44. Thus, the inner boom portion is reciprocally mounted in the channels of the upper boom member.

The sheep's foot roller is circular drum 70, FIGS. 4 and 5, having both ends partially closed by means of a annular plate 71 which is welded on the inside of the circular drum. The compacting sheep's foot extensions 72 depend from the exterior of the drum 70. An inner drum 74 is mounted at both ends on bearing sets 75 for rotating around a shaft 76 which is secured to the side arms or connectors 53 and 54 at opposite ends. The inner drum 74 is interiorly stepped at 77 to support the bearing sets at both ends, and the bearing sets are secured in position by means of a nut 78. The shaft is secured to arm 54 by means of a nut 79 bearing against a washer assembly 80 which bears against the nut 78. Similarly, the opposite end of the shaft is secured to the drum.

The assembly provides a sheep's foot roller 52 which is slightly wider than the maximum width of the extensible boom so that a ditching excavating may be compacted completely across its lateral extent without interference of the boom against the side walls of the excavation. In addition, the boom may be extended to place the sheep's foot roller at a desired depth in the backfill, for the compacting operation, regardless of the depth of the ditching excavation. The angle of the boom is controlled by the cylinder 34, so that the moment arm between the sheep's foot roller 52 and the rear wheels 14 and 16 may be accurately controlled to provide the desired compacing weight on the sheep's foot roller for uniformly compacting the ditch. In one mode of operation, the sheep's foot roller on the boom is lowered onto the backfilled ditch, with the wheels of the grader straddling the ditch. The cylinder 34 may be extended into the ditch so as to raise the front wheels 20 of the grader, whereby a portion of the weight of the grader is bearing on the sheep's foot roller 52. The actual compaction weight is determined by the distance of the moment arm between the sheep's foot roller and rear wheels. As the grader moves along the ditching excavation, the sheep's foot roller guides the grader along the ditch, while the operator may mostly attend the backfilling operation by the blade 22. Therefore, the operator may confine most of his attention to the backfill operation, while the compaction may proceed in normal course and withe the compacting wheel guiding the motor grader along the ditch. At the end of the ditch, the operator raises the sheep's foot roller turns the grader around and starts back down the ditch. This time, of course, with the roller raised (because of the backfill) and the angle of the boom changed so that the moment arm is controlled to provide the compaction which is deem necessary for the ditching operation. Of course, as the backfilling operation approaches the surface the boom is further retracted and the angle of the boom to the horizontal is reduced so as to maintain the desired moment arm and thus the compaction of the sheep's foot roller.

It has been found in ditching operation, the compaction of the ditch should approximate the compaction under the surrounding roadway in which the ditch is cut. This permits patched ditch to settle or expand in the same manner as a roadway, so as not to cause a bump or a depression where the ditching backfill has occurred. If the compaction of the backfill of the ditch is in excess of the compaction of the roadway a bump will occur, since the backfill will not contract or expand in the same manner as the roadway. On the other hand if the compaction is less than the roadway, the backfill tends to sink cuasing a depression where the ditch has occured. With the device of the invention the compaction may be easily and readially controlled by the operator of the motor grader by extension and retraction of the boom as well as the change of angle of the boom from the horizontal. Furthermore, the boom being narrower than the sheep's foot roller, the ditching excavation may be compacted from wall to wall without interference of the boom itself against the side wall of the excavation. The open configuration of the boom provides for easy maintances and cleaning during the ditching operations.

What is claimed is:

1. Earth compaction apparatus for attachment to a motor grader having front and rear wheels connected by a frame and a grader blade suspended downwardy from the frame between the wheels, for compacting back fill in deep, narrow ditches, the improvement comprising:

a. narrow extensible boom means pivotally secured to the frame between the front wheels of the grader at about axle level of said front wheels and spaced closely to the axle, said boom means extending forwardly of said front wheels, and being arranged to pivot upwardly and downwardly below the front wheels, said boom means being sufficiently narrow as to move in a ditch without touching the ditch walls;

b. means for pivoting said boom means about said pivotally secured attachment to thereby change the angle of the boom relative to a horizontal line, said means for pivoting said boom including a pair of spaced hydraulic cylinders connected between an upper portion of the grader frame disposed generally above said pivotal connection of said boom means with said frame, and a location on said boom means spaced from said pivotal connection, said pivoting means being arranged to pivot said boom means between a retracted, elevated position, and a lowered, operative position wherein the front wheels of said grader are elevated from the ground;

c. said boom means being formed of at least an outer member and an inner member reciprocably mounted in said outer member;

d. joining means between said boom means members for reciprocating the inner in relation to the outer member to thereby change the length of said boom means, said joining means and said pivoting means being operable in cooperation with each other to change the angle and the length of said boom means to adjust the moment arm between the end of said boom means and the rear wheels of said grader, to thereby control the compression of material in said ditch occurring because of the weight of the elevated front end of said grader exerted on said boom means; and e. rotary compacting means mounted at the end of said inner boom member having a width at least as wide as the width of the boom.

2. Earth compacting apparatus according to claim 1, wherein said outer boom means includes opposed, spaced channellike rails reciprocally holding said inner boom means, said rails being spaced apart by lateral, spaced cross members, and the ends of both of said rails being pivotally connected to said frame, one of said hydraulic cylinders being connected to each rail and lying generally in the same plane therewith.

3. Earth compaction apparatus according to claim 1, wherein said joining means is a hydraulic cylinder.

4. Earth compaction apparatus according to claim 1, wherein said compacting means is an essentially hollow sheep's foot roller.

5. Earth compaction apparatus according to claim 4, wherein said roller is mounted for rotation on a stationary shaft secured to connecting arms attached to said inner boom.

* * * * *